US006032879A

United States Patent [19]

Hamada et al.

[11] Patent Number: 6,032,879

[45] Date of Patent: Mar. 7, 2000

[54] FUEL INJECTOR FOR USE IN INTERNAL COMBUSTION ENGINE

[75] Inventors: Yasunaga Hamada, Hitachinaka; Hideo Tatsumi; Kenichi Gunji, both of Mito; Yukihiro Yoshinari, Hitachinaka, all of Japan

[73] Assignees: Hitachi, Ltd., Tokyo; Hitachi Car Engineering Co., Ltd., Ibaraki, both of Japan

[21] Appl. No.: 09/008,599

[22] Filed: Jan. 16, 1998

[30] Foreign Application Priority Data

Jan. 17, 1997 [JP] Japan ..... 9-006185

[51] Int. Cl.[7] ..... F02M 51/06

[52] U.S. Cl. ..... 239/585.1; 251/129.06

[58] Field of Search ..... 239/585.15; 251/129.06

[56] References Cited

FOREIGN PATENT DOCUMENTS 6-4367 1/1994 Japan .

*Primary Examiner*—Kevin P. Shaver
*Assistant Examiner*—D. Deal
*Attorney, Agent, or Firm*—Evenson, McKeown, Edwards & Lenahan, P.L.L.C.

[57] ABSTRACT

When an electromagnetic coil receives an electric supply, a stationary core, a yoke, and a movable core form a magnetic circuit. The movable core is attracted to a side of the stationary core against the force provided by a return spring member. A fuel passage for injection of fuel is then opened. Axial direction stepwise differences are formed on the movable core. One end face of the stationary core opposes the stepwise difference through a first gap. A projection portion of the yoke is provided toward an inner side of the yoke. This projection portion opposes a position of a side to provide an axial direction magnetic attraction through a second gap. By the provision of the first and second gaps, plural axial direction magnetic attraction gaps are formed and become a part of the magnetic circuit. By increasing a magnetic attraction efficiency of the movable core, an improvement in performance of a fuel injector and a fuel injector having a compact size and a light weight structure can be attained.

26 Claims, 6 Drawing Sheets

FUEL INJECTOR FOR USE IN INTERNAL COMBUSTION ENGINE

BACKGROUND OF THE INVENTION

1. Field of the Invention

The present invention relates to a fuel injector for use in an internal combustion engine and, more particularly, to a fuel injector for supplying directly the injecting fuel to a respective cylinder of an internal combustion engine in a vehicle such as an automobile.

2. Description of Related Art

In a conventional technique of this kind of a fuel injector for use in an internal combustion engine, the fuel injector has a fuel passage provided upstream of a valve seat. In this fuel injector, a stationary core and a movable core having a valve body are arranged in an axial direction in a yoke and, further, an electromagnetic coil is provided at an inner surrounding portion of the stationary core.

The movable core of the fuel injector is received through the spring force caused by a return spring member. During a non-electric supply of the electromagnetic coil, the valve body is contacted to a valve seat and the valve body is placed in a valve opening condition.

In accordance with electric supply to the electromagnetic coil of the fuel injector, the above stated three components comprised of the stationary core, the yoke, and the movable core form a magnetic circuit. By facing the spring force caused by the return spring member, the movable core is attracted at a side of the stationary core. A valve closing condition in the valve body is then presented.

Further, in the conventional fuel injector, it has been proposed to use a technique in which a swirler is provided at a side upstream of the valve seat of the fuel injector. During the valve opening condition of the valve body, the swirler can give the fuel swirling force to the fuel passing through the swirler and, by swirling the fuel mist, atomizing of the fuel in the fuel injector can be improved and so on.

Among various kinds of fuel injectors, a fuel injector being practiced widely is one having an injection system in which the fuel injector is provided on a part of an air intake passage of an internal combustion of an automobile. However, recently a DI system (a direct injection system) of the fuel injector has been developed; such a DI system is one in which the fuel injector is installed directly to a cylinder of the internal combustion engine and then the fuel is injected directly into the respective cylinder-of the engine.

In the above stated DI system fuel injector, since the fuel is injected directly into the respective cylinder of the engine, it can be estimated that injection is performed without adhesion of the fuel to an inner wall portion of an intake pipe. Further, the injector can provide a good combustion condition having a high efficiency, improve an output of the engine, and further can provide an improvement with respect to an exhaust gas purification.

In a case of DI system fuel injector, as to an aspect to the pressure withstanding property, an interior portion of the cylinder of the engine is placed in a high pressure state in which the pressure reaches about 70 kg/cm$^2$ at a maximum according to an explosion pressure of the engine. Therefore, there is a problem in that a valve member can be opened erroneously according to surpassing by far the pressure force in the cylinder of the engine against the spring force caused by the return spring member of the fuel injector.

However, recently, according to an improvement of a high pressure pump for supplying the fuel in the fuel injector, the fuel pressure is forced to be high in accordance with cooperation between the fuel pressure and the spring force caused by the return spring member. It is possible to give the valve a closing force which surpasses the above stated explosion pressure force caused by the engine. As a result, the above stated problems about the erroneous valve operation in the fuel injector can be resolved.

Further, as a result of the improvement in the fuel pressure in the fuel injector, since a necessary fuel injection amount can be supplied fully during an extremely limited time such as in an air intake process, a requirement for a responsibility property in the fuel injector can be complied with.

Further, as to an aspect of the responsibility property in the fuel injector, as stated in the above, to surpass the strong valve closing force, a drive electric voltage (a magnetic attraction force) of an electromagnetic coil is heightened using a booster pressure circuit.

To increase the magnetic attraction force in the fuel injector, a drive voltage of the fuel injector is boosted in pressure and a drive current value is increased. In addition, to reduce a consumption electric power for a vehicle such as an automobile, it is necessary to realize a magnetic attraction of the movable core with a high efficiency.

For example, in a fuel injector described in Japanese utility model laid-open publication No. Hei 6-4367, a flange is provided projecting to an upper end face of a side of the magnetic attraction (a side opposite to a lower end face of a stationary core) of a movable core and a tip end of this flange is extended largely toward a lower end face of a yoke. In other words, each of both end portions of the flange of the movable core of the fuel injection is extended over to an outer peripheral portion of the electromagnetic coil.

Accordingly, in this conventional fuel injector, a double gap structure having two gaps in the same horizontal direction to perform the magnetic attraction is provided. Each of the two gaps constituting the double gap structure in the fuel injector is provided at the substantially same horizontal faces and can generate the magnetic attraction force, respectively.

In the above conventional fuel injector, by securing one gap portion in an axial direction between the lower end face of the stationary core and an upper middle face of the flange of the movable core and another gap portion in the axial direction between the lower end face of the yoke and the upper end face of the flange of the movable core, the magnetic attraction area is increased.

However, to increase the magnetic attraction area using the flange provided on the movable core in the conventional fuel injector, the flange is formed to oppose the end face of the stationary core, the lower end face of the electromagnetic coil and the lower end face of the yoke.

As a result, the flange of the movable core is formed with a large outer diameter or the movable core having this flange structure is formed to have the large outer diameter. With such a large outer diameter movable core structure having the large outer diameter flange, an outer diameter of the yoke, which is arranged at an inner surrounding portion of the flange of the movable core, becomes large.

As a result, in the conventional fuel injector, a large size is necessary. Such a large size fuel injector structure is restricted from an aspect of installation for the fuel injector and tends to be a high cost structure.

SUMMARY OF THE INVENTION

The present invention aims to solve the above stated problems in the prior art, and an object of the present invention is to provide a fuel injector for use in an internal combustion engine wherein a magnetic attraction motion having a high efficiency in the fuel injector can be attained.

Another object of the present invention is to provide a fuel injector for use in an internal combustion engine wherein a small size fuel injector structure with a light weight structure can be attained.

A further object of the present invention is to provide a fuel injector for use in an internal combustion engine wherein compatibility of a magnetic attraction motion having a high efficiency in the fuel injector and a small size fuel injector structure with a light weight structure can be attained.

So as to attain the above stated objects, the present invention proposes the following means for solving the problems mentioned.

According to a first aspect of the present invention, in a fuel injector for use in an internal combustion engine, in which a stationary core and a movable core having a valve body are arranged in an axial direction, at least a part of the stationary core and the movable core are mounted on at an interior portion of a yoke. When an electromagnetic coil which is provided on a surrounding portion of the stationary core receives an electric supply, the stationary core, the yoke and the movable core form a magnetic circuit. The movable core is attracted against the force caused by a return spring member toward a side of the stationary core and then a fuel passage for injecting the fuel is opened.

Stepwise difference faces in an axial direction are formed at the movable core. One end face of the stationary core is opposite to one face forming the stepwise difference face through a first gap at the axial direction. A projection portion which forms a part of the magnetic circuit is provided on the yoke and directed toward an inner side of the yoke. The projection portion is opposite to another face for forming the stepwise difference face at a position of a side of an axial direction magnetic attraction through a second gap at the axial direction. By provision of the first gap and the second gap, plural axial direction magnetic attraction gaps which form a part of the magnetic circuit are constituted.

The movable core has a cylindrical portion and a flange member. An inner gap structure for performing a first magnetic attraction is provided between the cylindrical portion of the movable core and the stationary core. The cylindrical portion of the movable core is provided opposite to the stationary core, and an outer gap structure for performing a second magnetic attraction is provided between the flange member of the movable core and the yoke. The flange member of the movable core is provided opposite to the yoke, and an installation position of the outer gap structure is slipped off in the axial direction from an installation position of the inner gap structure.

Each of an outer tip end of the inner gap structure and an outer tip end of the outer gap structure is positioned within an interior portion departing from an installation position of the electromagnetic coil.

The movable core has a cylindrical portion at an upper portion and a flange member which is provided on a lower portion of the cylindrical portion. A projection portion is provided on an inner wall portion of the yoke. The projection portion is provided on an upper end face of the flange member of the movable core, and the projection portion is provided to surround an outer periphery of the cylindrical portion of the movable core. An inner gap structure for performing a first magnetic attraction is provided between an upper end face of the cylindrical portion of the movable core and a lower end face of the stationary core, the upper end face of the cylindrical portion of the movable core is provided opposite to the lower end face of the stationary core, and an outer gap structure for performing a second magnetic attraction is provided between an upper end face of the flange member of the movable core and a lower face of the projection portion provided on the yoke. The upper end face of the flange member of the movable core is provided opposite to a lower face of the projection portion provided on the yoke, and an installation position of the inner gap structure is slipped off in the axial direction at an installation position of the outer gap structure.

The movable core has a cylindrical portion at an upper portion and a flange member which is provided on a lower portion of the cylindrical portion. An inner projection portion is provided integrally and inwardly by projecting from an inner wall portion of the yoke, and the inner projection portion of the yoke is provided on an upper end face of the flange member of the movable core. The inner projection portion of the yoke is provided to surround an outer periphery of the cylindrical portion of the movable core. An inner gap structure for performing a first magnetic attraction is provided between an upper end face of the cylindrical portion of the movable core and a lower end face of the stationary core. The upper end face of the cylindrical portion of the movable core is provided opposite to the lower end face of the stationary core, and an outer gap structure for performing a second magnetic attraction is provided between an upper end face of the flange member of the movable core and a lower face of the inner projection portion of the yoke. The upper end face of the flange member of the movable core is provided opposite to the inner projection portion of the yoke, and an installation position of the inner gap structure is slipped off in the axial direction at an installation position of the outer gap structure.

The axial direction double gap structure of the movable core in the fuel injector according to the present invention can be formed, for example, by provisions of a stationary core opposite face which is opposite to a lower end face of the stationary core in the axial direction and a flange which is formed by slipping off in the axial direction against the stationary core opposite face.

According to the above stated fuel injector construction, in a case where the electromagnetic coil is supplied with an electric power, the stationary core, the yoke, and the movable core form the magnetic circuit, plural magnetic attraction gaps can be secured, and then a stroke of the movable core and a stroke of a valve body in an opening direction can be attained.

By the provisions of the axial direction plural magnetic attraction gaps, the magnetic attraction area at the axial direction (the stroke direction) against the movable core can be secured by the projection portion of the side of the yoke in addition to the one end face of the stationary core.

Accordingly, the axial direction magnetic attraction area can be increased and therefore the magnetic attraction efficiency in the axial direction of the movable core in the fuel injector can be heightened. Also, the drive current efficiency of the valve body in the fuel injector can be heightened.

In particular, in the above stated axial direction double gap fuel injector construction, in a case in which the gaps are larger than gaps which are formed between an outer side face of the movable core and an inner side face of the yoke, most magnetic flux can pass through the sides of the gaps; however the magnetic flux which passes through the gaps formed between the outer side face of the movable core and the inner side face of the yoke can be restrained.

Since most of the magnetic attraction force (so-called the side force) which is formed in a vertical direction against the axial direction of the movable core is restrained, the magnetic flux increase necessary for the stroke of the movable core can be obtained effectively.

Further, since the above axial direction double gap structure is secured by opposing one of the stepwise difference faces of the movable core to one end of the stationary core and opposing another of the stepwise difference faces to an inwardly directed projection portion provided at the side of the yoke, by arranging the side of the yoke near to the side of the movable core, one of the above stated gaps can be obtained.

Therefore, according to the present invention, it is unnecessary to extend the side of the flange of the movable core to the lower end face of the yoke by extending over the electromagnetic coil in the prior art. As a result, a movable core having a small diameter and a yoke having a small diameter which surrounds the movable core in the fuel injector can be obtained.

According to a second aspect of the present invention, in a fuel injector for use in an internal combustion engine, in which a stationary core and a movable core having a valve body are arranged in an axial direction, at least a part of the stationary core and the movable core are mounted on an interior portion of a yoke. When an electromagnetic coil which is provided on a surrounding portion of the stationary core receives an electric supply, the stationary core, the yoke and the movable core form a magnetic circuit. The movable core is attracted against the force caused by a return spring member toward a side of the stationary core and then a fuel passage for injecting the fuel is opened.

The movable core has a stationary core opposite face which opposes one end face of the stationary core in an axial direction through a first gap and a first taper face which is formed at an outer side face of the movable core and spreads over at a side of an antimagnetic attraction. A second taper face for spreading over reversibly against the first taper face of a side of the stationary core is provided on the yoke and is projected to an inner side of the yoke.

The second taper face of the side of the yoke is opposite to the first taper face of the side of the movable core at a position of the side of the axial direction magnetic attraction through a second gap. By provision of the first gap and the second gap, plural axial direction magnetic attraction gaps which form a part of the magnetic circuit are constituted.

Since the magnetic flux passing through the second gap which opposes the taper face contains many magnetic fluxes which work in the axial direction of the movable core, by the provisions of the first gap and the second gap, operations and effects similar to the first invention can be expected.

DESCRIPTION OF THE PREFERRED EMBODIMENTS

Figure 1A:
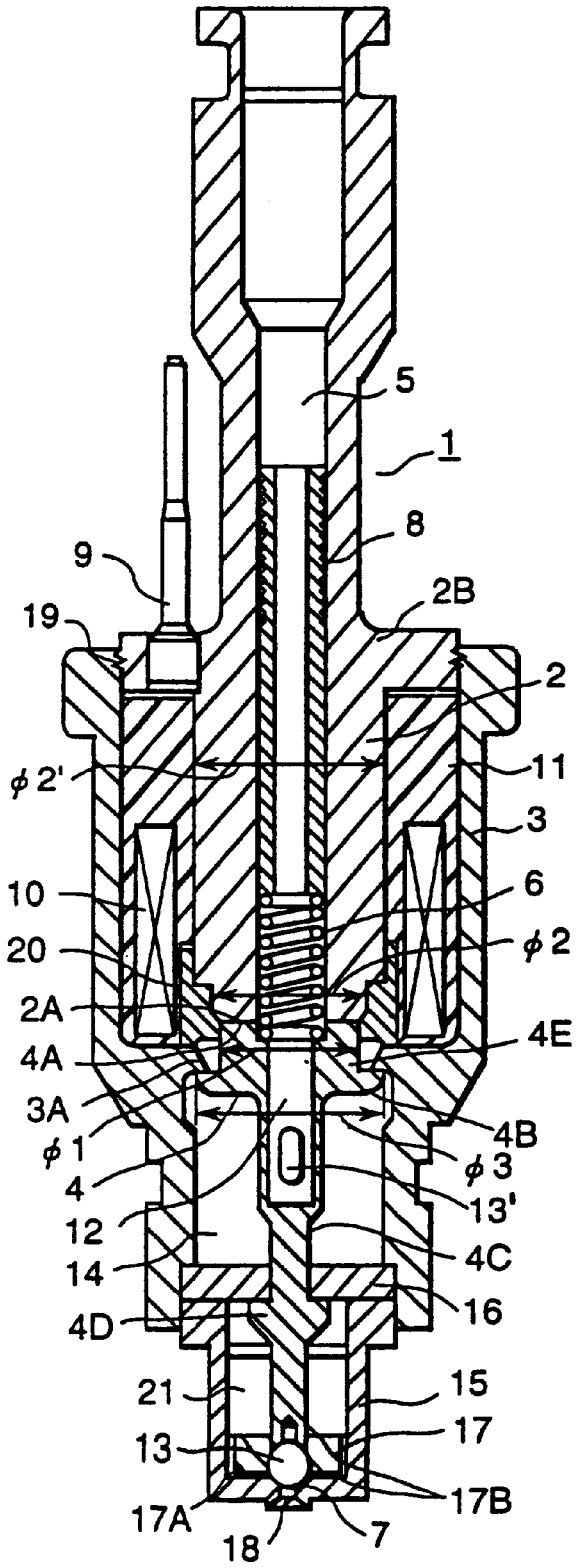
FIG. 1A is a longitudinally cross-sectional view showing a first embodiment of a fuel injector for use in an internal combustion engine according to the present invention.
Figure 1B:
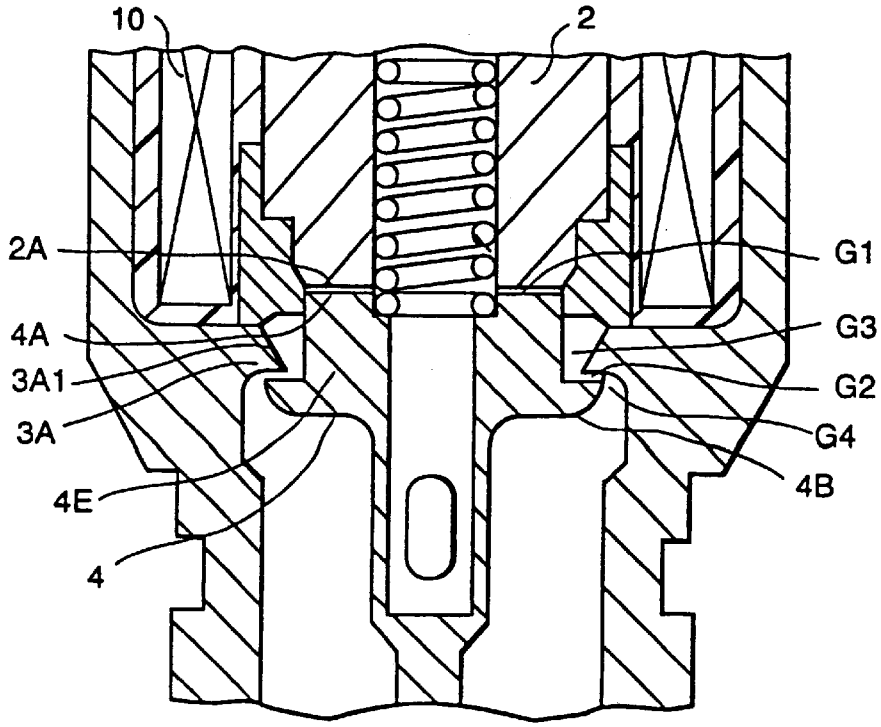
FIG. 1B is a longitudinally enlarged cross-sectional view showing a surrounding portion of a movable core having a flange of the first embodiment of the fuel injector shown in FIG. 1A.

Hereinafter, various embodiments of a fuel injector for use in an internal engine of an automobile according to the present invention will be explained by referring to drawings. FIG. 1A is a longitudinally cross-sectional view showing a first embodiment of a fuel injector for use in an internal combustion engine according to the present invention and FIG. 1B is a longitudinally enlarged cross-sectional view showing a surrounding portion of a movable core having a flange of the first embodiment of the fuel injector shown in FIG. 1A.

As shown in FIG. 1A, a fuel injector 1 for use in an internal combustion engine of an automobile of a first embodiment according to the present invention comprises mainly a stationary core 2, a yoke 3 and a movable core 4 as a magnetic circuit element of an actuator.

The stationary core 2 forms a long and slender shaped hollow cylindrical body. This stationary core 2 has a flange 2B at a middle outer wall portion of the hollow cylindrical body. A bottom half portion of the stationary core 2 under this flange 2B is mounted at an interior portion of the yoke 3. This flange 2B is fitted into an upper opening portion of the yoke 3 in a suitable fitting manner.

Further, by holding under pressure an inner peripheral edge of the upper opening portion of the yoke 3, indicated by reference number 19, the inner peripheral edge of the upper opening portion of the yoke 3 is fluidized. As a result, the stationary core 2 and the yoke 3 are combined plastically with each other. Further, in place of the above stated plastic combination method, another combination method, such as a caulking methods can be employed.

A terminal member 9 is provided on the flange 2B of the movable core 2. This terminal member 9 is used to apply a drive electric signal to an electromagnetic coil 10. A nozzle body 15 having a valve seat 7 is provided on a lower portion of the yoke 3.

A fuel passage 5 is formed in the interior portion of the stationary core 2 and the fuel passage 5 is passed through the stationary core 2 in an axial direction. A return spring member 6 of a movable core 4 is inserted into one end of the stationary core 2 (an end portion opposite to an inflow side of the fuel).

The movable core 4 is biased toward a valve closing direction (a valve seat 7 direction) through the spring force caused by this return spring member 6. A hollow spring member adjuster 8 is provided in the interior portion of the stationary core 2. This spring member adjuster 8 can adjust the spring force of the return spring member 6.

The electromagnetic coil 10 is covered by a molded resin member 11. At a central portion of hollow portion of the electromagnetic coil 10, a lower part of the stationary core 2, which corresponds to the lower portion from the flange 2B of the stationary core 2, is inserted and fixed. Both this electromagnetic coil 10 and the lower part of the stationary core 2 are mounted into the interior portion of the cylindrical yoke 3.

The molded resin member 11 protects the electromagnetic coil 10 and also prevents the leakage current from the electromagnetic coil 10. A seal ring 20 prevents the inflow of the fuel into a side of a coil assembly body.

The nozzle body 15, which has a cylindrical tube having a bottom portion, is fixed to the lower portion of the yoke 3. A fuel swirler (hereinafter called a swirler) 17 is arranged on an inner bottom portion of the nozzle body 15. This swirler 17 is positioned upstream of the valve seat 7.

The swirler 17 is a disc shape chip 17A. At a central portion of the swirler 17, a guide hole (a center hole) 18 for a spherical shape valve (a valve body) 13 is formed. A fuel passage groove 17B is formed at an outer peripheral portion and also at a bottom portion of the swirler 17. This fuel passage groove 17B communicates the fuel passage 21 and the guide hole 17A.

One end of the fuel passage groove 17B opens at a tangent line against the guide hole 17A. The fuel for flowing out to the guide hole 17A from the fuel passage groove 17B can then be swirled.

The movable core 4 is arranged to conform with an axial center of the stationary core 2 and to position over from the yoke 3 to the nozzle body 15. As a result, the movable core 4 can carry out, in the axial direction, a stroke operation.

The movable core 4 forms a cylindrical portion 4E and a flange 4B at a lower portion of the cylindrical portion 4E on an upper side thereof (a side of the stationary core 2).

The movable core 4 has a stationary core opposite face 4A on an upper face of the cylindrical portion 4E. This stationary core opposite face 4A of the cylindrical portion 4E opposes a lower end face 2A of the stationary core 2. The flange 4B of the movable core 4 is formed by slipping off the position at the axial direction against the stationary core opposite face 4A. By the provision of the stationary core opposite face 4A of the cylindrical portion 4E and an upper face of the flange 4B, two stepwise different faces are constituted in the axial direction on the movable core 4.

As shown in FIG. 1B, the stationary core opposite face 4A of the cylindrical portion 4E of the movable core 4 can form an upper side gap structure (an inner gap structure) having a gap G1 of 20 $\mu$m for forming a first magnetic attraction face against the lower end face 2A of the stationary core 2. The upper face of the flange 4B of the movable core 4 can form a lower gap structure (an outer gap structure) having a gap G2 of 20 $\mu$m for forming a second magnetic attraction face against a lower face of an inner wall projection portion 3A of the yoke 3.

The inner wall projection portion 3A is integrally provided projectingly from the yoke 3 and has an outwardly spreading taper face 3Al. This taper face 3Al is provided as a countermeasure to the leakage of the flux reduction.

In this first embodiment of the fuel injector 1 according to the present invention, an axial direction double gap structure for forming the magnetic attraction faces in the fuel injector 1 is constituted by the upper side gap structure (the inner gap structure) having the gap G1 for forming the first magnetic attraction face and the lower side gap structure (the outer gap structure) having the gap G2 for forming the second magnetic attraction face.

The axial direction double gap structure constituted by the upper side gap structure (the inner gap structure) having the gap G1 and the lower side gap structure (the outer gap structure) having the gap G2 in this first embodiment of the fuel injector 1 can be defined also by the provision of the upper side gap structure (the inner gap structure) having the gap G1 and the lower side gap structure (the outer gap structure) having the gap G2. Two stepwise difference faces for the magnetic attraction can be formed in the axial direction by slipping off the respective positions of the two magnetic attraction faces toward the axial direction.

An arrangement for forming the inner gap structure G1 is positioned within an outer diameter of the stationary core 2 and an arrangement for forming the outer gap structure G2 is positioned within an inner diameter of the electromagnetic coil 10. In other words, both the inner gap structure G1 and the outer gap structure G2 are positioned so that they are received within a range of the inner diameter of the electromagnetic coil 10. As a result, a fuel injector 1 having a small size can be obtained.

In this first embodiment of the fuel injector according to the present invention, at the movable core 4, a portion formed between the stationary core opposite face 4A of the cylindrical portion 4E and the flange 4B (the cylindrical portion 4E existing above the flange 4B of the movable core 2) has an outer diameter $\phi 1$ of 8 mm. Further, at the stationary core 2, a portion in which the stationary core 2 is inserted in the electromagnetic coil 10 and further which opposes the stationary core opposite face 4A of the cylindrical portion 4E of the movable core 4 has an outer diameter $\phi 2$ of 9 mm.

At the stationary core 2, a portion into which the stationary core 2 is inserted on the electromagnetic coil 10 has an outer diameter $\phi 2'$ of 10.9 mm, and the flange 4B of the movable core 4 has an outer diameter $\phi 3$ of 10.7 mm. A relationship between the dimensions of the above stated four outer diameters $\phi 1$, $\phi 2$, $\phi 2'$ and $\phi 3$, in this first embodiment of the fuel injector according to the present invention, is set so that $\phi 1 \approx \phi 2 < \phi 2' \approx \phi 3$.

According to this first embodiment of the fuel injector 1, the outer diameter $\phi 3$ of the flange 4B of the movable core 4 for forming the outer gap structure is set smaller than the inner diameter of the electromagnetic coil 10. In other words, the outer diameter $\phi 3$ of the flange 4B of the movable core 4 for forming the second magnetic attraction face is not extended past the inner side of the electromagnetic coil 10.

At a lower portion of the flange 4B of the movable core 4, a rod portion 4C is provided integrally with the movable core 4. On a lower end of this rod portion 4C, the spherical shape valve 13 is provided. An outer diameter of the rod portion 4C of the movable core 4 is smaller than the outer diameter $\phi 1$ of the cylindrical portion 4E of the movable core 4.

The spherical shape valve 13 is introduced into the interior portion of the nozzle body from the interior portion of the yoke 3. The spherical shape valve 13 is seated on the valve seat 7 in the interior portion of the guide hole 17A of the swirler 17. At an upper face of the cylindrical portion 4E of the movable core 4, a spring member receiving portion is formed. This spring member receiving portion receives the spring force of the return spring member 6 in a valve seat direction (a valve closing direction).

The projection part 3A of an inner wall of the yoke 3 projects toward an inner side direction and a lower face of this inner wall projection part 3A of the yoke 3 is provided to oppose the upper face of the flange 4B of the movable core 4 at a side of the magnetic attraction in the axial direction of the movable core 2. This lower face of the inner wall projection portion 3A of the yoke 3 and upper face of the flange 4B of the movable core 4 are formed oppositely in the axial direction through the outer gap G2.

The inner wall projection portion 3A of the yoke 3 forms the cone like projection shape inner projection portion 3A1. A tip end of the inner wall projection portion 3A of the yoke 3 is projected toward the inner side from an inner diameter of the electromagnetic coil 10. The lower face of the inner wall projection portion 3A of the yoke 3 is set to enable opposition to the upper face of the flange 4B having the outer diameter of ϕ3 of the movable core 4 to form the magnetic attraction force.

This inner wall projection portion 3A of the yoke 3 forms a part of the magnetic circuit; however in a case where structural consideration of the magnetic circuit is no obstacle, it is possible to constitute the inner wall projection portion 3A of the yoke 3 of a separate material which differs from the material for forming the yoke 3. The projection portion 3A may be constituted separately and independently so as to differ from the yoke 3.

As shown in FIG. 1B, the inner gap G1 of 20 μm, formed between the stationary core opposite face 4A of the cylindrical portion 4E of the movable core 4 and the lower end face 2A of the stationary core 2, and the outer gap G2 of 20 μm, formed between the lower face of the yoke inner wall projection portion 3A of the yoke 3 and the upper face of the flange 4B of the magnetic core 4, are smaller than a gap G3 of more than 0.5 mm formed between the outer side face of the cylindrical portion 4E of the movable core 4 and an inner face 3A1 of the yoke inner wall projection portion 3A of the yoke 3 and a gap G4 of 0.5–1.0 mm formed between the outer face of the flange 4B of the movable core 4 and the inner wall face of the yoke 3.

As a result, more of the flux of the magnetic circuit passes through the portions of the gaps G1 and G2 than the portions of the gaps G3 and G4 in this embodiment of the fuel injector 1. According to the provisions of the gaps G1 and G2, the double gap structure for the movable core attraction in the axial direction, which forms the part of the magnetic circuit, can be constituted.

In this first embodiment of the fuel injector 1 according to the present invention, since a reverse cone shape taper is formed in the lower direction at the outer side face of the flange 4B of the movable core 4, by securing the flux for passing through the outer gap G2, the gap G3 is formed as large as possible.

Each of the gaps G1 and G2 according to this embodiment of the fuel injector 1 is formed a little larger than the stroke amount (the stoke is regulated by a stopper 16, as stated later, and the valve seat 7) of the movable core 4 and the stroke operation of the movable core 4 can be secured; however the clearance is minute.

Further, in a case where the movable core 4 is attracted electromagnetically, the movable core 4 contacts only the non-magnetic property stopper 16, and direct contact between the stationary core 2 and the yoke 3 can be prevented. As a result, by avoiding the residual magnetic effects to the utmost, the responsibility property of the stroke operation of the movable core 4 in the fuel injector 1 can be heightened.

An opposite area S1 formed between the stationary core opposite face 4A of the cylindrical portion 4E of the movable core 4 and the lower end face of the stationary core 2 is substantially the same as an opposite area S2 formed between the lower face of the yoke inner wall projection portion 3A of the yoke 3 and the upper face of the flange 4B of the movable core 4.

Part of the movable core 4 forms a hollow portion. The hollow portion of the movable core 4 can be secured to a fuel passage portion 12 which communicates with the fuel passage 5 of the stationary core 2. A side of the fuel passage portion 12 is positioned in a fuel passage 14 in the yoke 3.

The stopper (a stationary core side stopper) 16 for regulating the stroke in the opening direction of the movable core 4 is positioned between the lower end portion of the yoke 3 and the nozzle body 15. In this stopper 16, the rod portion 4C of the movable core 4 is inserted and passed through. On the movable core 4, a small flange 4D is provided to correspond to the stopper 16 and forms a movable core side stopper.

The stationary core 2, the yoke 3 and the movable core 4 are constituted from the magnetic property material members. On the other hand, the stopper 16 and the seal ring 20 are constituted from the non-magnetic property material members.

Next, an operation of the first embodiment of the fuel injector 1 according to the present invention will be explained in detail.

During a non-excitation condition of the electromagnetic coil 10, the spherical valve 13 is acted upon by the spring force caused by the return spring member 6. The spherical valve 13 is contacted with the valve seat 7 and, in this case, the fuel injector 1 presents the closing valve condition.

In a case where the electric signal is applied to the electromagnetic coil 10, the stationary core 3, the yoke 2, and the movable core 4 form the magnetic circuit. Then, the movable core 4 is magnetically attracted to the side of the stationary core 2.

Further, the spherical valve 13 and also the movable core 4 are guided and moved toward the inner periphery of the swirler 17. The spherical valve 13 separates from the valve seat 7 and then the spherical valve 13 is opened. The movement amount of the movable core 4 is regulated according to the stopper 16. Between the spherical valve 13 and the valve seat 7, a ring shape clearance having a desirable opening area can be formed.

The fuel is supplied to the fuel passage 5 of the stationary core 2 through a fuel pump, a fuel pressure regulator and an accumulator (not shown in the figures). This fuel is passed through the spring member adjuster 8 and the fuel passage 12 of the movable core 4 and then through a passage hole 13', an interior portion 14 of the yoke 3 and an interior portion 21 of the nozzle body 15; after that, the fuel reaches the swirler 17.

The fuel passing through the swirler 17 is forced to a desirable swirl by the swirler 17 and the fuel is passed through the valve seat 7 and the orifice 18. After that, the fuel is directly cylinder-in injected to the respective cylinder of the engine of the automobile.

By the electric supply to the electromagnetic coil 10, in a case where the stationary core 2, the yoke 3 and the movable core 4 form the magnetic circuit, by the provision of the axial direction double gap structure of the gaps G1 and G2, an opposite area for the magnetic attraction use in the axial direction can be increased; further the flux of the movable core 4 in the stroke direction (the axial direction) can be increased.

As a result, the magnetic attraction efficiency of the movable core 4 in the axial direction (the drive current efficiency of the valve body) in the fuel injector 1 can be heightened.

In particular, in the above stated fuel injector construction of this first embodiment, the gaps G1 and G2 are smaller than the gaps G3 and G4 formed between the outer side face of the movable core 4 and the inner side face of the yoke 3.

Most flux passes through the side of the gaps G1 and G2. However, the flux passing through the gaps G3 and G4 formed between the outer side face of the movable core 4 and the inner side face of the yoke 3 (the flux in the vertical direction against the axial direction of the movable core 4) is restrained. The occurrence of the magnetic attraction (the side force) in the vertical direction against the axial direction of the movable core 4 is hardly restrained at all. As a result, it is effective to-make the flux increase in the fuel injector 1 in the stroke direction of the movable core 4.

Figure 2:
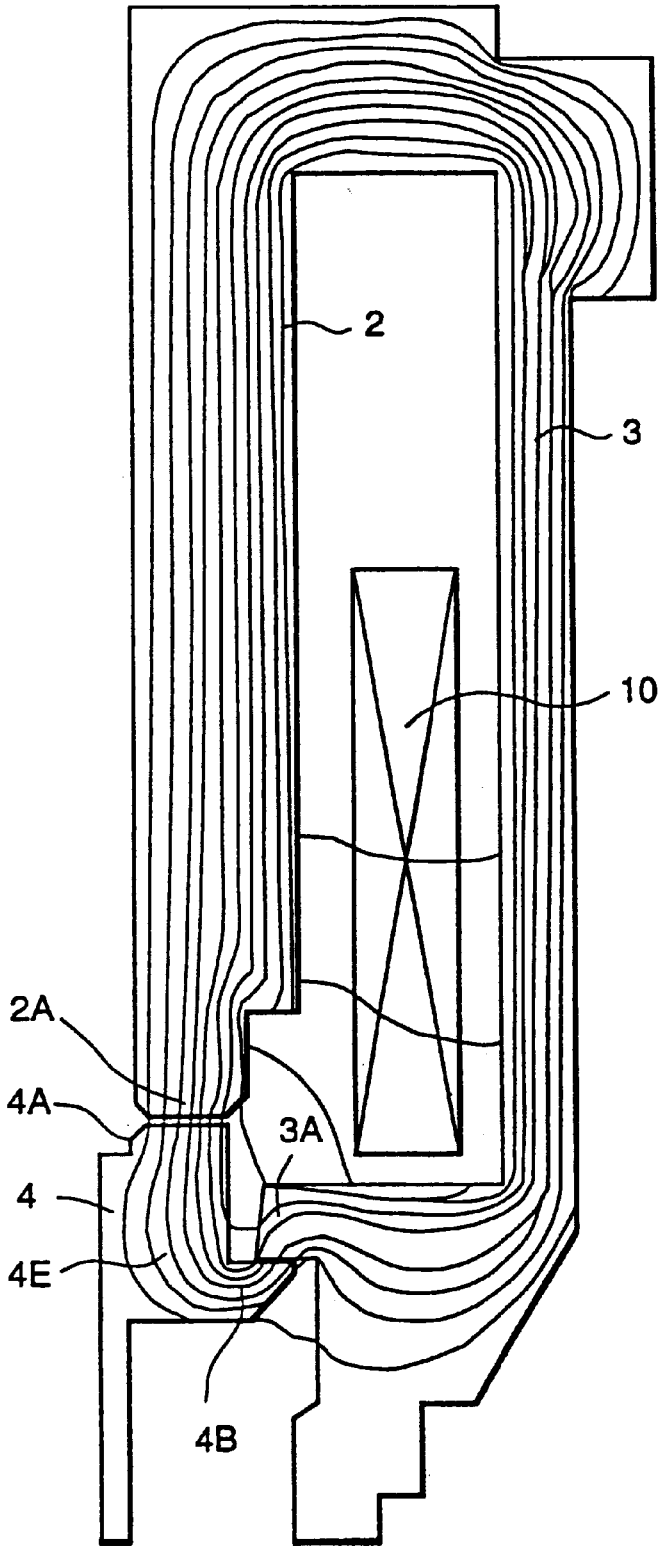
FIG. 2 is an explanatory view of a magnetic flux distribution which passes through a magnetic circuit of the first embodiment of the fuel injector according to the present invention.
Figure 3:
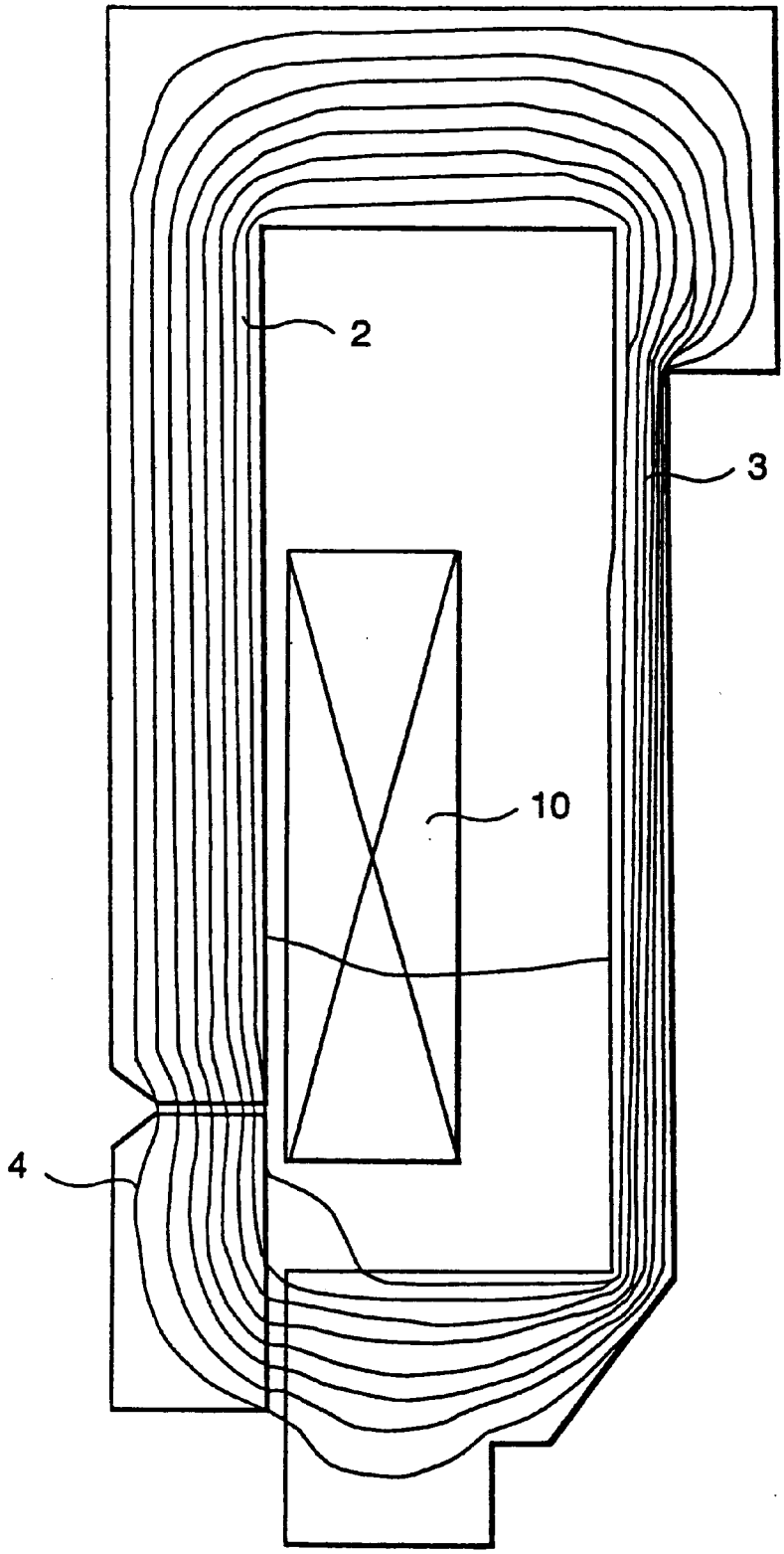
FIG. 3 PRIOR ART
FIG. 3 is an explanatory view of a magnetic flux distribution which passes through a magnetic circuit of a fuel injector according to the prior art.

FIG. 2 shows the flux distribution of the magnetic circuit of the first embodiment of the fuel injector according to the present invention. FIG. 3 shows the flux distribution of this kind of magnetic circuit of the fuel injector according to the prior art.

As is clear from FIG. 2 and FIG. 3, the flux pass through amount in the axial direction in the first embodiment of the fuel injector according to the present invention is more than that of the fuel injector according to the prior art. Further, in the first embodiment of the fuel injector according to the present invention, by restraining the side force, the magnetic attraction efficiency in the fuel injector 1 can be heightened.

Figure 4:
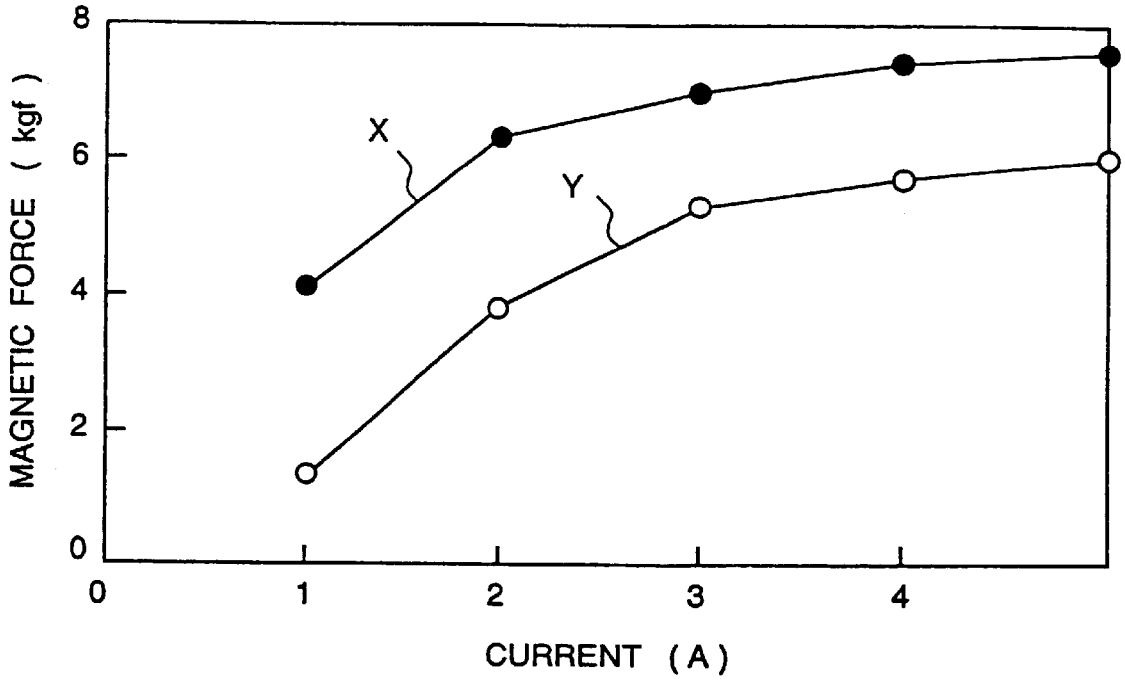
FIG. 4 is an explanatory view of an experimentation result of a magnetic attraction force according to the present invention and an experimentation result of a magnetic attraction force according to the prior art.

FIG. 4 shows experimentation results which support the above stated facts according to the present invention. In FIG. 4, a curve X indicates a result of the magnetic attraction force according to the present invention and a curve Y indicates a result of the magnetic attraction force according to the prior art.

In obtaining the experimentation results shown in FIG. 4, the current applied to the electromagnetic coil 10 was varied in a range of 1–5 A. The measurement results of the magnetic attraction force at that time were determined.

An outer diameter of the movable core main body having the double gap structure of the fuel injector according to the prior art was 9 mm. On the other hand, the outer diameter ($\phi 1$) of the movable core main body having the vertical direction double gap structure of the first embodiment of the fuel injector 1 according to the present invention was 8 mm.

Table 1 shows a comparison of the applied current value and the magnetic attraction force according to the present invention (the axial direction double gap structure) with those of the double gap structure according to the prior art.

TABLE 1

| | magnetic force measurement (kgf) | | | | |
|---|---|---|---|---|---|
| current (A) | 1 | 2 | 3 | 4 | 5 |
| prior art (9 mm) | 1.3 | 3.8 | 5.3 | 5.7 | 6 |
| present invention (8 mm) | 4.1 | 6.3 | 7 | 7.4 | 7.6 |

In both the prior art and the present invention, the material of the movable core was an electromagnetic stainless steel. As a result, the magnetic attraction force of the first embodiment of the fuel injector 1, having an outer diameter of the movable core main body of 8 mm according to the present invention, can be made greater than that of the fuel injector having an outer diameter of the movable core main body of 9 mm according to the prior art.

Further, in this first embodiment of the fuel injector 1 according to the present invention, the installation position of the flange 4B provided on the movable core 4 slips off toward the axial direction against the stationary core opposite face 4A of the cylindrical portion 4E of the movable core 4. Further, in the yoke 3, the projection part 3A of the inner wall of the yoke 3 is projected toward an inner side of the inner diameter of the electromagnetic coil 10. The projection part 3A of the inner wall of the yoke 3 is set opposite to the flange 4B in the axial direction.

In the prior art it is necessary to extend the flange toward the end face of the yoke; however in the first embodiment of the fuel injector 1 according to the present invention, it is unnecessary to extend the flange 4B toward the end face of the yoke 3.

As a result, the flange structure has a small diameter (in concrete terms, the structure has an outer diameter ($\phi 3$) of 10.7 mm for the flange 4B of the movable core 4, which is substantially the same as the outer diameter ($\phi 2'$) of 10.9 mm for the stationary core 2) and the yoke 3 structure, which surrounds the flange 4B having the small diameter movable core 4, can be attained.

As a result, the combination of the improvement in performance, compact size, and light weight structure in the fuel injector 1 according to the present invention can be attained.

Figure 5:
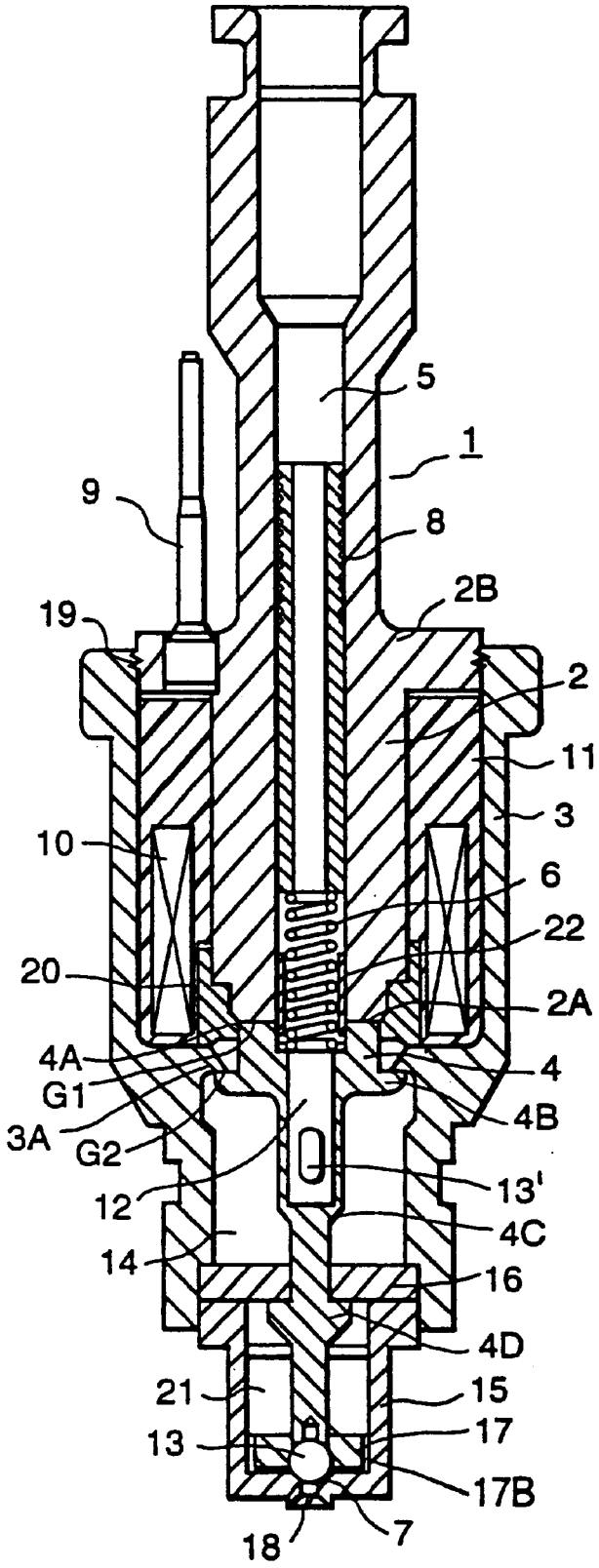
FIG. 5 is a longitudinally cross-sectional view showing a second embodiment of a fuel injector for use in an internal combustion engine according to the present invention.

FIG. 5 shows a second embodiment of a fuel injector according to the present invention, and in this figure, the same reference numerals in the first embodiment indicate the same elements or related elements.

The fuel injector structure of the second embodiment according to the present invention has substantially same fuel injector structure as the fuel injector structure of first embodiment according to the present invention. The difference in the structures of the fuel injector 1 shown in the second embodiment in comparison with the fuel injector 1 shown in the first embodiment is as follows.

A non-magnetic guide ring 22 is provided on the upper portion of the end portion of the movable core 4 and through this non-magnetic guide ring 22, the movable core 4 is guided to the inner periphery of the end portion of the stationary core 2. The lower portion of the return spring member 6, having a smaller outer diameter in comparison with the return spring member in the first embodiment, is received in this guide ring 22. In the above stated fuel injector 1 construction, the same axial direction double gap structure shown in the first embodiment is employed.

Figure 6:
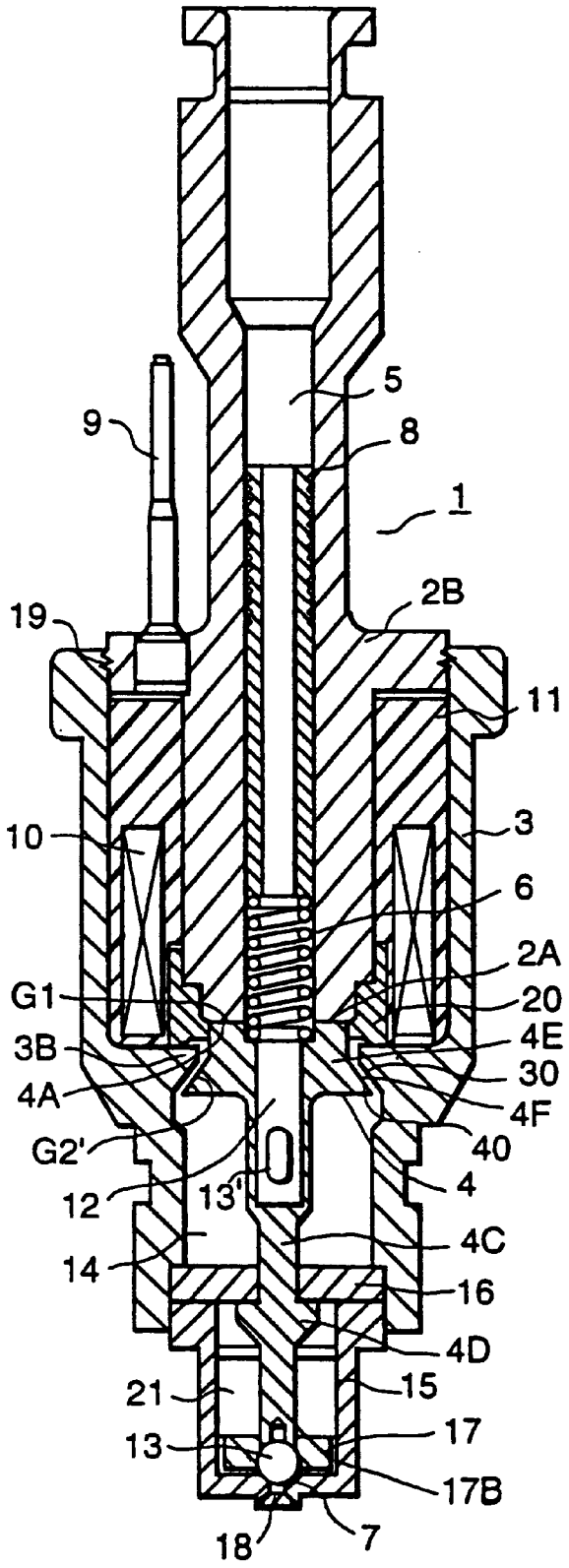
FIG. 6 is a longitudinally cross-sectional view showing a third embodiment of a fuel injector for use in an internal combustion engine according to the present invention.

FIG. 6 is a third embodiment of a fuel injector according to the present invention. The difference in the structures of the fuel injector 1 shown in the third embodiment in comparison with the fuel injector shown in the first embodiment is the following.

The movable core 4 of the fuel injector 1 of the third embodiment has the stationary core opposite face 4A of the cylinder portion 4E of the movable core 4. This stationary core opposite face 4A is opposite to the lower end face 2A of the stationary core 2 in the axial direction.

The movable core 4 in the fuel injector 1 shown in this third embodiment according to the present invention further has an outwardly spreading taper face 40 on a slanting face 4F of the movable core 4. In this taper face 40, the position of the taper face 40 is slipped off in the axial direction against the above stated stationary core opposite face 4A of the cylinder portion 4E of the movable core 4. This taper face 40 provided on the movable core 4 spreads over toward a side of an anti-magnetic attraction to a side wall face of the side of the movable core On the other hand, in the side of the yoke 3, inwardly spreading taper face 30 is formed at a part of an inner wall projection portion 3B of the yoke 3. This taper f-ace 30 provided on the yoke 3 is projected at an inner side so as to be opposite, at the position of the side of the magnetic attraction, the taper face 40 of the side of the movable core 4.

The taper face 30 of the yoke 3 spreads over reversibly against the taper face 40 of the movable core 4. The maximum diameter of the taper face 40 at the side of the movable core 4 has substantially the same diameter as the outer diameter (ϕ2') of the stationary core 2. A tip end of the taper face 30 of the projection portion 3B of the side of the yoke 3 is positioned within the inner diameter of the electromagnetic coil 10.

The axial direction double gap structure for the magnetic attraction in the fuel injector 1 of this third embodiment is constituted by an opposite gap G1 and an opposite gap G2'. The opposite gap G1 in the axial direction is formed between the stationary core opposite face 4A of the movable core 4 and the lower face 2A of the stationary core 2. The opposite gap G2' is further formed between the taper face 30 of the side of the yoke 3 and the taper face 40 of the side on the movable core 4.

In the fuel injector 1 of this third embodiment according to the present invention, the fluxes which pass through the opposite gap G2' formed between the taper face 40 of the movable core 4 and the taper face 30 of the yoke 3 include many magnetic attraction components which can work in the axial direction. By the provision of the gap G1 and the gap G2' in the fuel injector 1 of this third embodiment, operations and effects similar to those of the first embodiment can be expected.

With the fuel injector according to the present invention, by increasing the magnetic attraction efficiency in the movable core, an improvement in the performance of the fuel injector can be obtained. Further, a fuel injector having a compact size and light weight structure can be attained.

In particular, the present fuel injector is suitable for use as a DI (direct injection) system fuel injector which requires improved responsiveness. Further, the present invention can be adapted to fuel injectors including a DI fuel injector system.

What is claimed is:

1. A fuel injector for use in an internal combustion engine comprising:

a stationary core and a movable core having a valve body arranged in an axial direction, at least parts of said stationary core and said movable core being mounted on an interior portion of a yoke, an electromagnetic coil provided on a surrounding portion of said stationary core which receives an electric supply so that said stationary core, said yoke and said movable core form a magnetic circuit, and a return spring member causing a force such that the movable core is attracted against the force caused by a return spring member toward an end face of said stationary core to open a fuel passage for injecting fuel, wherein stepwise difference faces are formed in an axial direction at said movable core;

wherein said end face of said stationary core opposes one of said stepwise difference faces through a first gap in the axial direction;

wherein a projection portion which forms a part of said magnetic circuit is provided on said yoke and directed inwardly of said yoke; and wherein another face opposing said projection portion and forming another of said stepwise difference faces is defined at a position opposing said projection portion through a second gap in the axial direction;

said first gap and said second gap defining plural axial direction magnetic attraction gaps which form a part of said magnetic circuit.

2. A fuel injector for use in an internal combustion engine according to claim 1, wherein said projection portion provided on said yoke includes a tip end which is projected inwardly from an inner diameter of said electromagnetic coil.

3. A fuel injector according to claim 2, wherein when a cylindrical portion of said movable core which is formed between said stationary core opposite face to said flange on said movable core has an outer diameter (ϕ1), a first portion of said stationary core which is inserted in said electromagnetic coil and is opposite to said stationary core opposite face has an outer diameter (ϕ2), a second portion of said stationary core which is inserted in said electromagnetic coil and is positioned at an upper side of said first portion has an outer diameter (ϕ2'), and said flange on said movable core has an outer diameter (ϕ3), a formula $\phi 1 \approx \phi 2 < \phi 2' \approx \phi 3$ is set.

4. A fuel injector for use in an internal combustion engine according to claim 3, and further comprising:

a stopper provided at a side of said stationary core to regulate an opening direction stoke of said movable core, said stopper being set at a separated position from said end face of said stationary core and said projection portion directed inwardly of said inner side of said yoke.

5. A fuel injector for use in an internal combustion engine according to claim 3, and further comprising:

a guide ring provided at an end portion of said movable core so that, through said guide ring, said movable core is guided to an inner periphery of an end portion of said stationary core.

6. A fuel injector for use in an internal combustion engine according to claim 2, and further comprising:

a stopper provided at a side of said stationary core to regulate an opening direction stoke of said movable core, said stopper being set at a separated position from said end face of said stationary core and said projection portion directed inwardly of said inner side of said yoke.

7. A fuel injector for use in an internal combustion engine according to claim 2, and further comprising:

a guide ring provided at an end portion of said movable core so that, through said guide ring, said movable core is guided to an inner periphery of an end portion of said stationary core.

8. A fuel injector for use in an internal combustion engine according to claim 1, and further comprising:

a stopper provided at a side of said stationary core to regulate an opening direction stoke of said movable core, said stopper being set at a separated position from said end face of said stationary core and said projection portion directed inwardly of said inner side of said yoke.

9. A fuel injector for use in an internal combustion engine according to claim 1, and further comprising:

a guide ring provided at an end portion of said movable core so that, through said guide ring, said movable core is guided to an inner periphery of an end portion of said stationary core.

10. A fuel injector for use in an internal combustion engine comprising:

a stationary core and a movable core having a valve body arranged in an axial direction, at least parts of said stationary core and said movable core being mounted on an interior portion of a yoke, an electromagnetic coil provided on a surrounding portion of said stationary core which receives an electric supply so that said stationary core, said yoke and said movable core form a magnetic circuit, and a return spring member causing a force such that the movable core is attracted against the force caused by a return spring member toward an end face of said stationary core to open a fuel passage for injecting fuel, wherein a stationary core opposite face on said movable core opposes said end face of said stationary core in an axial direction through a first gap and a flange is defined on said movable core which is displaced in the axial direction from said stationary core opposite face;

wherein a projection portion which forms a part of said magnetic circuit is provided to said yoke and directed inwardly of said yoke; and wherein another face on said flange opposes said projection portion through a second gap in the axial direction;

said first gap and said second gap defining plural axial direction magnetic attraction double gaps which form a part of said magnetic circuit.

11. A fuel injector according to claim 10, wherein when a cylindrical portion of said movable core which is formed between said stationary core opposite face to said flange on said movable core has an outer diameter ($\phi 1$), a first portion of said stationary core which is inserted in said electromagnetic coil and is opposite to said stationary core opposite face has an outer diameter ($\phi 2$), a second portion of said stationary core which is inserted in said electromagnetic coil and is positioned at an upper side of said first portion has an outer diameter ($\phi 2'$), and said flange on said movable core has an outer diameter ($\phi 3$), a formula $\phi 1 \approx \phi 2 < \phi 2' \approx \phi 3$ is set.

12. A fuel injector for use in an internal combustion engine according to claim 11, and further comprising:

a stopper provided at a side of said stationary core to regulate an opening direction stoke of said movable core, said stopper being set at a separated position from said end face of said stationary core and said projection portion directed inwardly of said inner side of said yoke.

13. A fuel injector for use in an internal combustion engine according to claim 11, and further comprising:

a guide ring provided at an end portion of said movable core so that, through said guide ring, said movable core is guided to an inner periphery of an end portion of said stationary core.

14. A fuel injector for use in an internal combustion engine according to claim 10, wherein said projection portion provided on said yoke includes a tip end which is projected inwardly from an inner diameter of said electromagnetic coil.

15. A fuel injector according to claim 14, wherein when a cylindrical portion of said movable core which is formed between said stationary core opposite face to said flange on said movable core has an outer diameter ($\phi 1$), a first portion of said stationary core which is inserted in said electromagnetic coil and is opposite to said stationary core opposite face has an outer diameter ($\phi 2$), a second portion of said stationary core which is inserted in said electromagnetic coil and is positioned at an upper side of said first portion has an outer diameter ($\phi 2'$), and said flange on said movable core has an outer diameter ($\phi 3$), a formula $\phi 1 \approx \phi 2 < \phi 2' \approx \phi 3$ is set.

16. A fuel injector for use in an internal combustion engine according to claim 15, and further comprising:

a stopper provided at a side of said stationary core to regulate an opening direction stoke of said movable core, said stopper being set at a separated position from said end face of said stationary core and said projection portion directed inwardly of said inner side of said yoke.

17. A fuel injector for use in an internal combustion engine according to claim 15, and further comprising:

a guide ring provided at an end portion of said movable core so that, through said guide ring, said movable core is guided to an inner periphery of an end portion of said stationary core.

18. A fuel injector for use in an internal combustion engine according to claim 14, and further comprising:

a stopper provided at a side of said stationary core to regulate an opening direction stoke of said movable core, said stopper being set at a separated position from said end face of said stationary core and said projection portion directed inwardly of said inner side of said yoke.

19. A fuel injector for use in an internal combustion engine according to claim 14, and further comprising:

a guide ring provided at an end portion of said movable core so that, through said guide ring, said movable core is guided to an inner periphery of an end portion of said stationary core.

20. A fuel injector for use in an internal combustion engine according to claim 10, and further comprising:

a stopper provided at a side of said stationary core to regulate an opening direction stoke of said movable core, said stopper being set at a separated position from said end face of said stationary core and said projection portion directed inwardly of said inner side of said yoke.

21. A fuel injector for use in an internal combustion engine according to claim 10, and further comprising:

a guide ring provided at an end portion of said movable core so that, through said guide ring, said movable core is guided to an inner periphery of an end portion of said stationary core.

22. A fuel injector for use in an internal combustion engine comprising:

a stationary core and a movable core having a valve body arranged in an axial direction, at least parts of said stationary core and said movable core being mounted on an interior portion of a yoke, an electromagnetic coil provided on a surrounding portion of said stationary core which receives an electric supply so that said stationary core, said yoke and said movable core form a magnetic circuit, and a return spring member causing a force such that the movable core is attracted against the force caused by a return spring member toward an end face of said stationary core to open a fuel passage for injecting fuel, wherein a stationary core opposite face on said movable core opposes said end face of said stationary core in an axial direction through a first gap and a first taper face is formed on an outer side face of said movable core and spreads outwardly;

wherein a second taper face for spreading over said first taper face is provided on said yoke and projects inwardly of said yoke; and wherein said second taper face opposes said first taper face on said movable core through a second gap;

said first gap and said second gap defining plural axial direction magnetic attraction gaps which form a part of said magnetic circuit.

23. A fuel injector for use in an internal combustion engine comprising:

a yoke;

a stationary core arranged in an axial direction so that at least a part of said stationary core is mounted on an interior portion of said yoke;

a movable core arranged in the axial direction and within said yoke, said movable core opposing said stationary core; and an electromagnetic coil arranged on an inner surrounding portion of said stationary core;

said yoke, said stationary core and said movable core forming a magnetic circuit;

wherein said movable core has a cylindrical portion and a flange member, an inner gap is provided between said cylindrical portion of said movable core and said stationary core, said cylindrical portion of said movable core is provided to oppose said stationary core, an outer gap is provided between said flange member of said movable core and said yoke, said flange member of said movable core is provided to oppose said yoke, and said outer gap is displaced in the axial direction from said inner gap structure.

24. A fuel injector for use in an internal combustion engine comprising:

a yoke;

a stationary core arranged in an axial direction so that at least a part of said stationary core is mounted on an interior portion of said yoke;

a movable core arranged in the axial direction and within said yoke, said movable core opposing said stationary core; and an electromagnetic coil arranged on an inner surrounding portion of said stationary core;

said yoke, said stationary core and said movable core forming a magnetic circuit;

wherein said movable core has a cylindrical portion and a flange member, wherein an inner gap is provided between said cylindrical portion of said movable core and said stationary core, wherein said cylindrical portion of said movable core is provided to oppose said stationary core, wherein an outer gap is provided between said flange member of said movable core and said yoke, wherein said flange member of said movable core is provided to oppose said yoke, wherein said outer gap is displaced in the axial direction from said inner gap, and wherein an outer end of said inner gap and an outer end of said outer gap are positioned within an interior of said electromagnetic coil.

25. A fuel injector for use in an internal combustion engine comprising:

a yoke;

a stationary core arranged in an axial direction so that at least a part of said stationary core is mounted on an interior portion of said yoke;

a movable core arranged in the axial direction and within said yoke, said movable core opposing said stationary core; and an electromagnetic coil arranged on an inner surrounding portion of said stationary core;

said yoke, said stationary core and said movable core forming a magnetic circuit;

wherein said movable core has a cylindrical portion at an upper portion and a flange member which is provided on a lower portion of said cylindrical portion, a projection portion is provided on an inner wall of said yoke, said projection portion is provided with a face opposing an upper end face of said flange member of said movable core, and said projection portion surrounds an outer periphery of said cylindrical portion of said movable core, wherein an inner gap is provided between an upper end face of said cylindrical portion of said movable core and a lower end face of said stationary core, wherein said upper end face of said cylindrical portion of said movable core opposes said lower end face of said stationary core, an outer gap is provided between an upper end face of said flange member of said movable core and a lower face of said projection portion provided on said yoke and said upper end face of said flange member of said movable core opposes said lower face of said projection portion provided on said yoke, and wherein said inner gap is displaced in the axial direction from said outer gap.

26. A fuel injector for use in an internal combustion engine comprising:

a yoke;

a stationary core arranged in an axial direction so that at least a part of said stationary core is mounted on an interior portion of said yoke;

a movable core arranged in the axial direction and within said yoke, said movable core opposing said stationary core; and an electromagnetic coil arranged on an inner surrounding portion of said stationary core;

said yoke, said stationary core and said movable core forming a magnetic circuit;

wherein said movable core has a cylindrical portion at an upper portion thereof and a flange member which is provided on a lower portion of said cylindrical portion, an inner projection portion is provided so as to integrally and inwardly project from an inner wall portion of said yoke, said inner projection portion of said yoke is provided with a face opposinq an upper end face of said flange member of said movable core, and said inner projection portion of said yoke surrounds an outer periphery of said cylindrical portion of said movable core, wherein an inner gap is provided between an upper end face of said cylindrical portion of said movable core and a lower end face of said stationary core, wherein said upper end face of said cylindrical portion of said movable core opposes said lower end face of said stationary core, an outer gap is provided between an upper end face of said flange member of said movable core and a lower face of said inner projection portion of said yoke and said upper end face of said flange member of said movable core opposes said inner projection portion of said yoke, and wherein said inner gap is displaced in the axial direction from said outer gap.

* * * * *